US010589968B2

(12) United States Patent
Holmberg et al.

(10) Patent No.: US 10,589,968 B2
(45) Date of Patent: Mar. 17, 2020

(54) METHOD FOR OPERATING WINCH, AND WINCH

(71) Applicant: ABB Technology Oy, Helsinki (FI)

(72) Inventors: Mikael Holmberg, Porvoo (FI); Risto Tiihonen, Kotka (FI); Michael Rodas, Espoo (FI)

(73) Assignee: ABB Schweiz AG, Baden (CH)

( * ) Notice: Subject to any disclaimer, the term of this patent is extended or adjusted under 35 U.S.C. 154(b) by 353 days.

(21) Appl. No.: 15/406,180

(22) Filed: Jan. 13, 2017

(65) Prior Publication Data

US 2017/0203940 A1 Jul. 20, 2017

(30) Foreign Application Priority Data

Jan. 15, 2016 (EP) ..... 16151423

(51) Int. Cl.
*B66D 1/50* (2006.01)
*B63B 21/16* (2006.01)
*B66D 1/12* (2006.01)

(52) U.S. Cl.
CPC ..... *B66D 1/505* (2013.01); *B63B 21/16* (2013.01); *B66D 1/12* (2013.01); *B66D 2700/0141* (2013.01)

(58) Field of Classification Search
CPC .. B66D 1/505; B66D 1/12; B66D 2700/0141; B63B 21/16
See application file for complete search history.

(56) References Cited

U.S. PATENT DOCUMENTS 3,388,070 A 6/1968 Ellis et al.
3,693,939 A * 9/1972 Buckson ..... B66C 13/22 254/268
4,118,012 A * 10/1978 Kerr ..... B66D 1/52 212/272

(Continued)

FOREIGN PATENT DOCUMENTS

EP 2385011 A1 11/2011
GB 1212442 A 11/1970
JP S60252593 A 12/1985

(Continued)

OTHER PUBLICATIONS

European Search Report, EP16151423, dated Jul. 6, 2016, ABB Technology Oy, 6 pages.

(Continued)

*Primary Examiner* — Sang K Kim
*Assistant Examiner* — Nathaniel L Adams
(74) *Attorney, Agent, or Firm* — Taft Stettinius & Hollister LLP; J. Bruce Schelkopf

(57) ABSTRACT

A method for operating a winch and a winch comprising a winch drum for spooling a spoolable medium for mooring a vessel, and a winch drive configured to drive the winch drum, wherein, during the driving of the winch drum, at least when a monitored tension of the spoolable medium is between a second upper tension threshold and a second lower tension threshold, an absolute value of the driving speed of the winch drum is configured to have a value that is proportional to an absolute value of a difference between the monitored tension of the spoolable medium and a predetermined tension set point.

15 Claims, 3 Drawing Sheets

(56) References Cited

U.S. PATENT DOCUMENTS

| | | | | |
|---|---|---|---|---|
| 8,207,692 | B2 * | 6/2012 | Holmberg | B66D 1/505 114/230.1 |
| 2010/0116191 | A1 | 5/2010 | Holmberg et al. | |

FOREIGN PATENT DOCUMENTS

| | | | |
|---|---|---|---|
| JP | 2011236056 | A | 11/2011 |
| KR | 1020100052424 | A | 5/2010 |
| KR | 1020110123680 | A | 11/2011 |

OTHER PUBLICATIONS

Japanese Office Action dated Jan. 29, 2018; Japanese Application No. 2017-004247; 9 pgs. (including translation).

* cited by examiner

METHOD FOR OPERATING WINCH, AND WINCH

FIELD OF THE INVENTION

The invention relates to operating a winch, in particular a winch comprising a winch drum for spooling a spoolable medium for mooring a vessel, and to a winch.

BACKGROUND OF THE INVENTION

Winches can be used for mooring a vessel. Such a vessel may be a ship, a boat or generally a craft designed for water transportation in a sea, an ocean, a lake, a river, a channel, a canal, or any parts thereof, for example.

Such a winch used for the mooring may comprise a winch drum which is rotatable about an axis of rotation thereof and may be used for spooling a spoolable medium, which is to be connected to a point of mooring. The spoolable medium may comprise a cable, a rope, a wire or a chain, for example. The point of mooring may be any point where the vessel can be moored, such as a mooring-post of a vessel landing place, e.g. a port or a pier, or an anchor or a buoy, for example. The winch used for the mooring may further comprise an electric motor drive comprising an electric motor, which is configured to rotate the winch drum about the axis of rotation thereof during spooling in or spooling out of the spoolable medium. The electric motor drive can be an AC drive or a DC drive and the electric motor can be an AC motor, such as an asynchronous motor (induction motor) or a synchronous motor, or a DC motor, respectively, for example.

In a vessel, the mooring functionality of the winch used for mooring can control the spoolable medium that holds the vessel in place at the point of mooring by means of the electric motor drive. When the vessel is being moored, the tension of the spoolable medium between the vessel and the point of mooring can be automatically adjusted by suitably controlling the electric motor drive that controls the winch used for mooring. The tension of the spoolable medium between the vessel and a point of mooring should be kept at an appropriate level. If the spoolable medium between the vessel and the point of mooring is too loose, the vessel will not stay in place, and if the spoolable medium is too tight, the spoolable medium might break or the operation might become unstable.

The electric drive can be controlled such that when the tension of the spoolable medium between the vessel and a point of mooring is outside a predetermined hysteresis zone, the spoolable medium is either tightened (spooled in) or loosened (spooled out) at a predetermined constant driving speed of the winch drum towards a predetermined tension set point. And when the tension of the spoolable medium between the vessel and the point of mooring has been inside a predetermined dead band zone, located within the hysteresis zone, for a certain predetermined period of time, the tightening or loosening is stopped.

Controlling the adjustment of the spoolable medium smoothly close to the predetermined tension set point is desirable. However, in the above solution, oscillations around the predetermined tension set point can easily occur and resulting sudden stops can be harmful to the mechanics of the winch and the spoolable medium, for example.

BRIEF DESCRIPTION OF THE INVENTION

The object of the invention is thus to provide a method and an apparatus for implementing the method so as to solve or at least alleviate the above problem. The object of the invention is achieved with a method, a computer program product, and a winch that are characterized by what is stated in the independent claims. Preferred embodiments of the invention are described in the dependent claims.

The invention is based on the idea that an absolute value of the driving speed of the winch, when spooling in or out the spoolable medium, is set proportional to an absolute value of a difference between a monitored tension of the spoolable medium between the vessel and a point of mooring and a predetermined tension set point, at least when the monitored tension of the spoolable medium is inside a predetermined dead band zone.

An advantage of the invention is that the tension control of the spoolable medium around the predetermined tension set point is smooth and well-controlled. Moreover, such proportional speed control will reduce any oscillations around the predetermined tension set point. This can improve the reliability of the operation of the winch and extend the lifetime of the spoolable medium.

BRIEF DESCRIPTION OF THE FIGURES

In the following, the invention will be described in more detail in connection with preferred embodiments with reference to the accompanying drawings, in which.

DETAILED DESCRIPTION OF THE INVENTION

Figure 1:
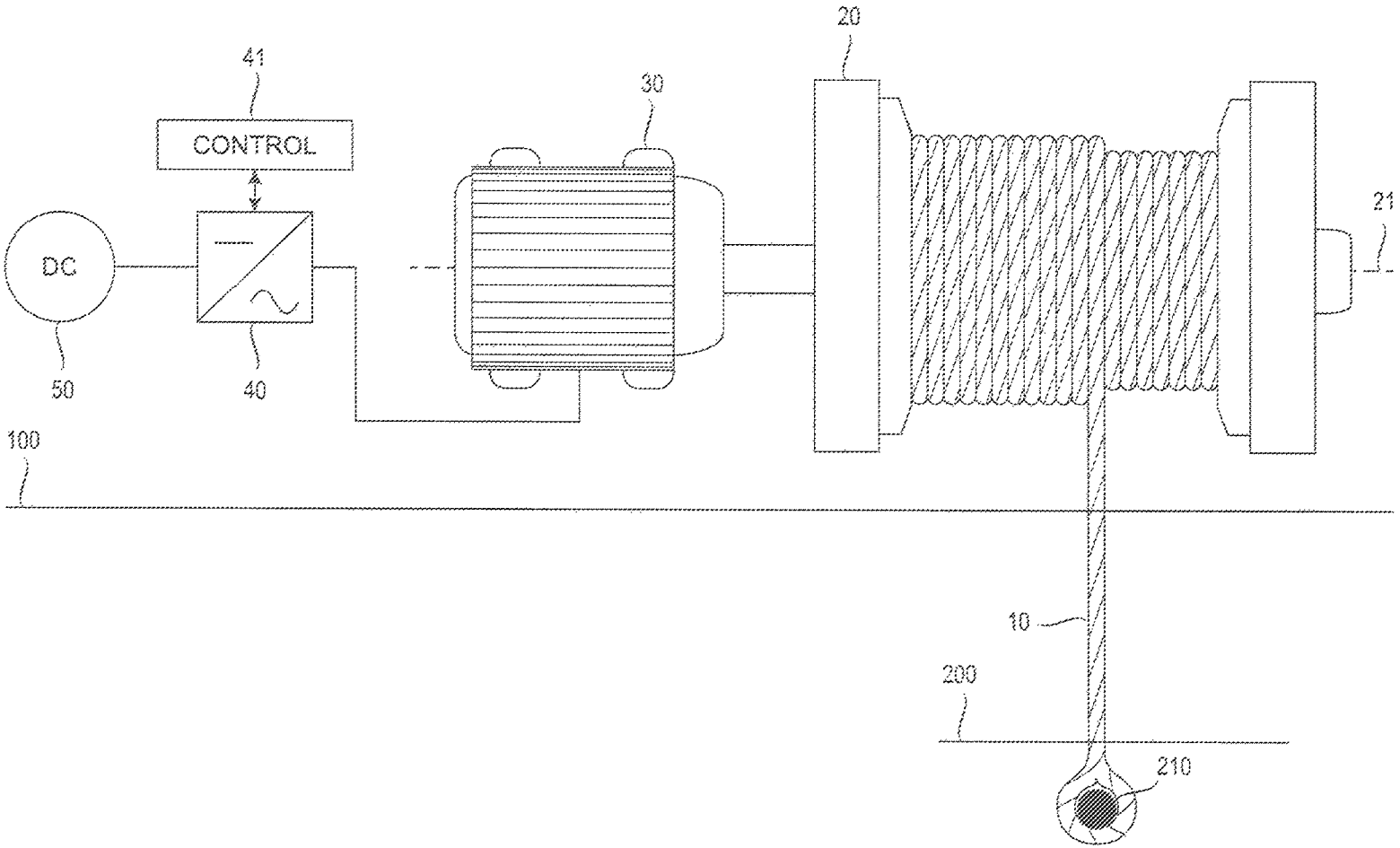
FIG. 1 illustrates a diagram of a winch according to an embodiment.

FIG. 1 illustrates a simplified diagram of a winch that can be used for mooring a vessel according to an embodiment. The figure only shows components necessary for understanding the various embodiments. The exemplary winch comprises a winch drum 20 for spooling a spoolable medium 10, which winch drum is rotatable about an axis of rotation 21. The spoolable medium 10 may be a cable, a rope, a wire or a chain, for example. In the example of FIG. 1, the winch further comprises a winch drive, in this example an electric drive comprising an electric motor 30, with which the winch drum 20 can be rotated. The electric motor 30 driving the winch drum 20 can be of any type, such as an asynchronous AC motor, such as an induction motor, a synchronous AC motor or a DC motor. Possible examples of the synchronous AC motor include non-excited motors, such as a reluctance motor, a hysteresis motor and a permanent magnet motor, and DC-excited motors, for example. It should be noted that the use of the embodiments described herein is not limited to systems employing any specific fundamental frequency or any specific voltage level, for example. In the example of FIG. 1, the electric motor 30 is an induction motor and the electric dive further comprises an inverter 40 for feeding the electric motor 30 from a DC power supply 50. An inverter is a device used, for instance, for controlling a motor. The control of the electric motor 30 may be implemented reliably by means of the inverter 40 in such a manner that the motor 30 accurately implements a desired speed or torque instruction, for example. The exemplary embodiment further comprises a separate control unit 41 of the electric drive which may be used to control the inverter 40 and, thus, the electric motor 30 and to operate the winch. The control unit 41 may also be a part of the inverter 40 or some other unit, for example. The control unit 41 may comprise suitable I/O (Input-Output) means, such as a keyboard and display unit or another separate terminal unit, which may be connected to the control unit 41 in a wired or wireless manner. Thus, an operator or user of the system can operate the winch through the I/O means.

FIG. 1 further illustrates a fixing point 210 for the spoolable medium 10, wherein the end of the spoolable medium 10 is to be fixed to the fixing point 210 during the mooring of the vessel. According to an embodiment, the winch 20, 30, 40, 41 used for the mooring of the vessel can be located in the vessel. In that case the fixing point 210 for the spoolable medium 10 is located at the point of mooring, such as a mooring-post of a vessel landing place, e.g. a port or a pier, or an anchor or a buoy, for example. According to this alternative, reference numeral 100 in FIG. 1 refers to the vessel and reference numeral 200 refers to the point of mooring. According to an alternative embodiment, the winch 20, 30, 40, 41 used for mooring the vessel can be located in the point of mooring, i.e. outside of the vessel. In that case the fixing point 210 for the spoolable medium 10 is located in the vessel. According to this alternative embodiment, reference numeral 200 in FIG. 1 refers to the vessel and reference numeral 100 refers to the point of mooring.

According to an embodiment, a winch for mooring a vessel can be operated as follows. A tension of the spoolable medium 10 between the vessel and a point of mooring is monitored. According to an embodiment, the tension of the spoolable medium 10 between the vessel and a point of mooring can be monitored by monitoring a torque of the electric motor 30. According to an embodiment, the torque of the electric motor 30 can be monitored by monitoring a current of the electric motor. It also possible to monitor the tension of the spoolable medium 10 between the vessel and a point of mooring utilizing some other quantities indicative of the tension of the spoolable medium 10. The monitoring of the tension of the spoolable medium 10 between the vessel and a point of mooring can be performed by the winch drive, e.g. by the control unit 41 thereof, or some other possible separate device or system. Then, in response to the monitored tension of the spoolable medium becoming higher than a first upper tension threshold or lower than a first lower tension threshold, initiating, either immediately or after a first predetermined delay, driving of the winch drum 20. According to an embodiment, during the driving of the winch drum 20, when the monitored tension of the spoolable medium 10 is higher than a predetermined tension set point, which has a value between the first upper tension threshold and the first lower tension threshold, the winch drum 20 is driven in such a direction that the spoolable medium 10 is spooled out, and, when the monitored tension of the spoolable medium 10 is lower than the predetermined tension set point, the winch drum 20 is driven in such a direction that the spoolable medium is spooled in. In other words, if the monitored tension of the spoolable medium 10 deviates from the predetermined tension set point during the driving of the winch drum 20, the winch drum 20 is preferably driven into such direction in which the monitored tension of the spoolable medium tends to approach the predetermined tension set point. Moreover, according to an embodiment, during the driving of the winch drum 20, at least when the monitored tension of the spoolable medium 10 is between a second upper tension threshold, which has a value equal to or lower than the first upper tension threshold but higher than the predetermined tension set point, and a second lower tension threshold, which has a value equal to or higher than the first lower tension threshold but lower than the predetermined tension set point, an absolute value of the driving speed of the winch drum has a value, which is proportional to an absolute value of a difference between the monitored tension of the spoolable medium and the predetermined tension set point. And, in response to the monitored tension of the spoolable medium 10 being, during the driving of the winch drum 20, between the second upper tension threshold and the second lower tension threshold for a second predetermined delay, stopping the driving of the winch drum 20. The values of the first upper tension threshold T1*u*, the first lower tension threshold T1*l*, the second upper tension threshold T2*u*, and the second lower tension threshold T2*l* depend on the system characteristics and may thus vary.

When the monitored tension of the spoolable medium 10 is higher than the second upper tension threshold, or when the monitored tension of the spoolable medium 10 is lower than the second lower tension threshold, the absolute value of the driving speed of the winch drum 20 could also have a value that is proportional to an absolute value of a difference between the monitored tension of the spoolable medium and the predetermined tension set point. Alternatively, according to an embodiment, during the driving of the winch drum 20, when the monitored tension of the spoolable medium 10 is higher than the second upper tension threshold, or when the monitored tension of the spoolable medium 10 is lower than the second lower tension threshold, the absolute value of the driving speed of the winch drum 20 has a value that is a predetermined constant after the driving speed of the winch drum has reached said predetermined constant driving speed. In this case, there may be an initial period where the driving speed is gradually increased to said predetermined constant value after which the driving speed is kept at said constant value. Said constant value may be the maximum driving speed of the winch drum or a fraction thereof, for example. Using such essentially constant driving speed instead of a variable speed based on the difference between the monitored tension of the spoolable medium and the predetermined tension set point, when the tension of the spoolable medium 10 is higher than the second upper tension threshold or lower than the second lower tension threshold may be advantageous in order to initially provide a higher speed of spooling, for example.

Figure 2:
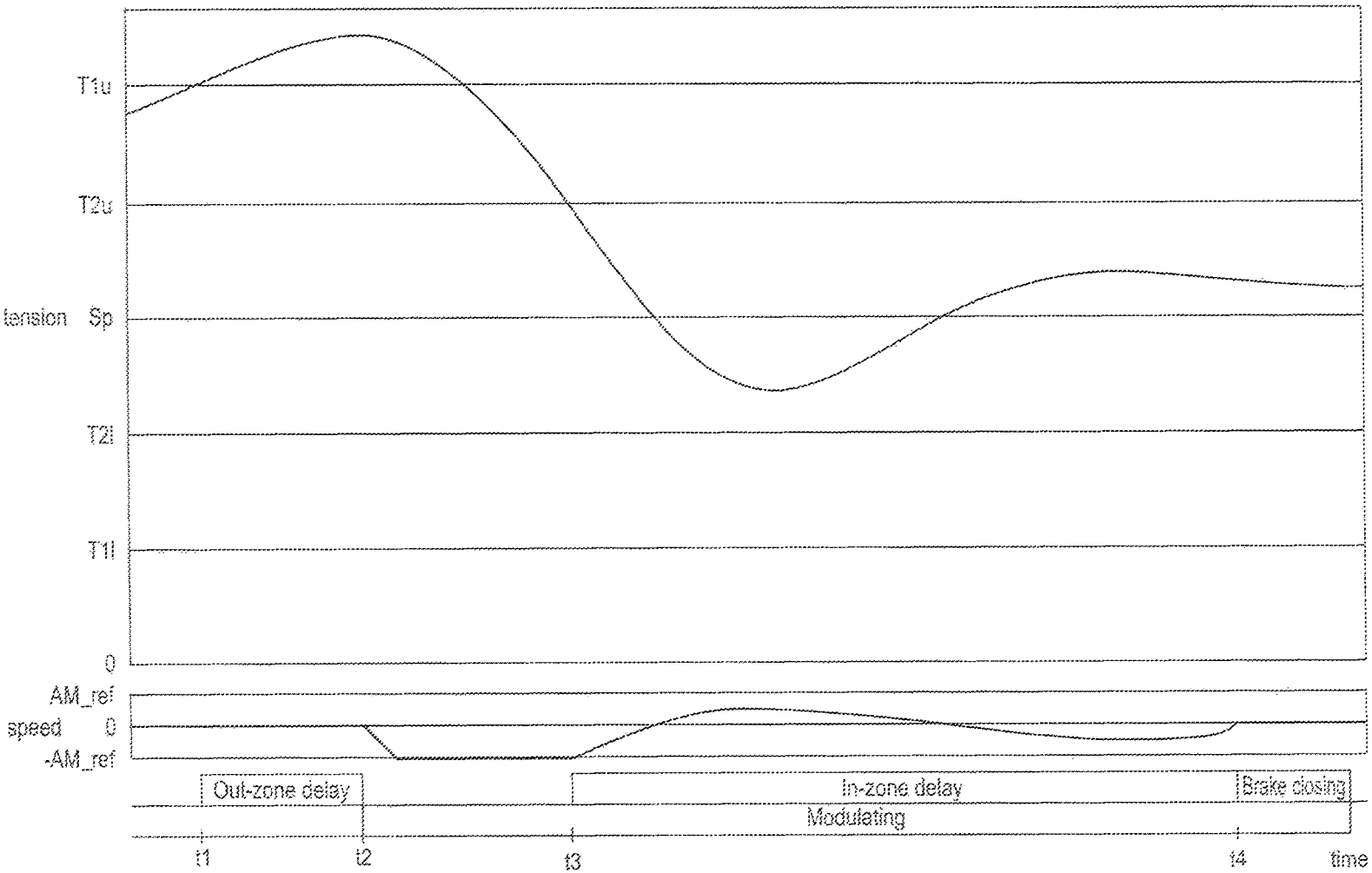
FIG. 2 illustrates tension and speed diagrams according to an embodiment.

FIG. 2 illustrates an example of tension and speed diagrams according to an embodiment. In the example of FIG. 2 the tension of the spoolable medium 10 goes outside the zone (hysteresis zone) defined between the first upper tension threshold T1*u* and the first lower tension threshold T1*l* by exceeding the first upper tension threshold T1*u* at time point t1. In this example the driving of the winch drum 20 is not initiated immediately thereafter but only after the first predetermined delay (Out-Zone delay). The first predetermined delay, if applied, may be a few seconds or a few tens of seconds depending on system characteristics, for example, and preferably it is between 0 and 20 s, more preferably 2 s to 10 s. After the first predetermined delay, at time point t2 the driving of the winch drum 20 is initiated and set, optionally gradually, at a constant speed −AM_ref. In this example the negative sign of the speed of the winch drum indicates that the spoolable medium 10 is spooled out. As a result, the tension of the spoolable medium 10 starts to gradually approach the predetermined tension set point Sp. At time point t3 the tension of the spoolable medium 10 enters the zone (dead band zone) defined between the second upper tension threshold T2*u* and the second lower tension threshold T2*l*. As a result, the absolute value of the driving speed of the winch drum 20 has a value that is proportional to the absolute value of the difference between the monitored tension of the spoolable medium and the predetermined tension set point Sp. The value of the driving speed of the winch drum 20 then varies between the maximum positive and negative speeds AM_ref, −AM_ref depending on the difference between the monitored tension of the spoolable medium and the predetermined tension set point Sp. After the second predetermined delay (In-Zone delay) after entering the zone defined between the second upper tension threshold T2*u* and the second lower tension threshold T2*l*, i.e. at time point t4, the driving of the winch drum 20 is stopped. The stopping of the driving of the winch drum 20 may include controlling the speed of the winch drum 20 to zero with suitable modulation control by the inverter 40 and/or braking the winch drum 20 with a brake. The second predetermined delay may be a few seconds or a few tens of seconds depending on system characteristics, for example, and preferably it is between 5 s and 100 s, more preferably 15 s to 60 s.

According to an embodiment, the absolute value of the driving speed of the winch drum may be determined according to the following equations:

a) when the monitored tension of the spoolable medium is between the second upper tension threshold T2*u* and the predetermined tension set point Sp:

$$|Ref|=AM_ref*([|Rt-Sp|]/[|T2u-Sp|]), \text{ and} \quad (1)$$

b) when the monitored tension of the spoolable medium is between the second lower tension threshold T2*l* and the predetermined tension set point Sp:

$$|Ref|=AM_ref*([|Rt-Sp|]/[|T2l-Sp|]), \quad (2)$$

where:

Ref=the driving speed of the winch drum
AM_ref=a predetermined constant
Rt=the monitored tension of the spoolable medium
Sp=the predetermined tension set point
T2*u*=the second upper tension threshold
T2*l*=the second lower tension threshold.

Thus, according to equations 1 and 2, when the monitored tension of the spoolable medium 10 is between the second upper tension threshold and the second lower tension threshold, the absolute value of the driving speed of the winch drum can be directly proportional to the absolute value of the difference between the monitored tension of the spoolable medium and the predetermined tension set point. It should be noted that the invention is not limited to the above form of equations 1 and 2 but they could vary. For example, the right hand sides of equations 1 and 2 could comprise a positive factor q whose value deviates from 1, i.e. q>0 and q·1. Moreover, the absolute value of the driving speed of the winch drum could alternatively be exponentially or logarithmically proportional to the absolute value of the difference between the monitored tension of the spoolable medium and the predetermined tension set point, for example.

Figure 3:
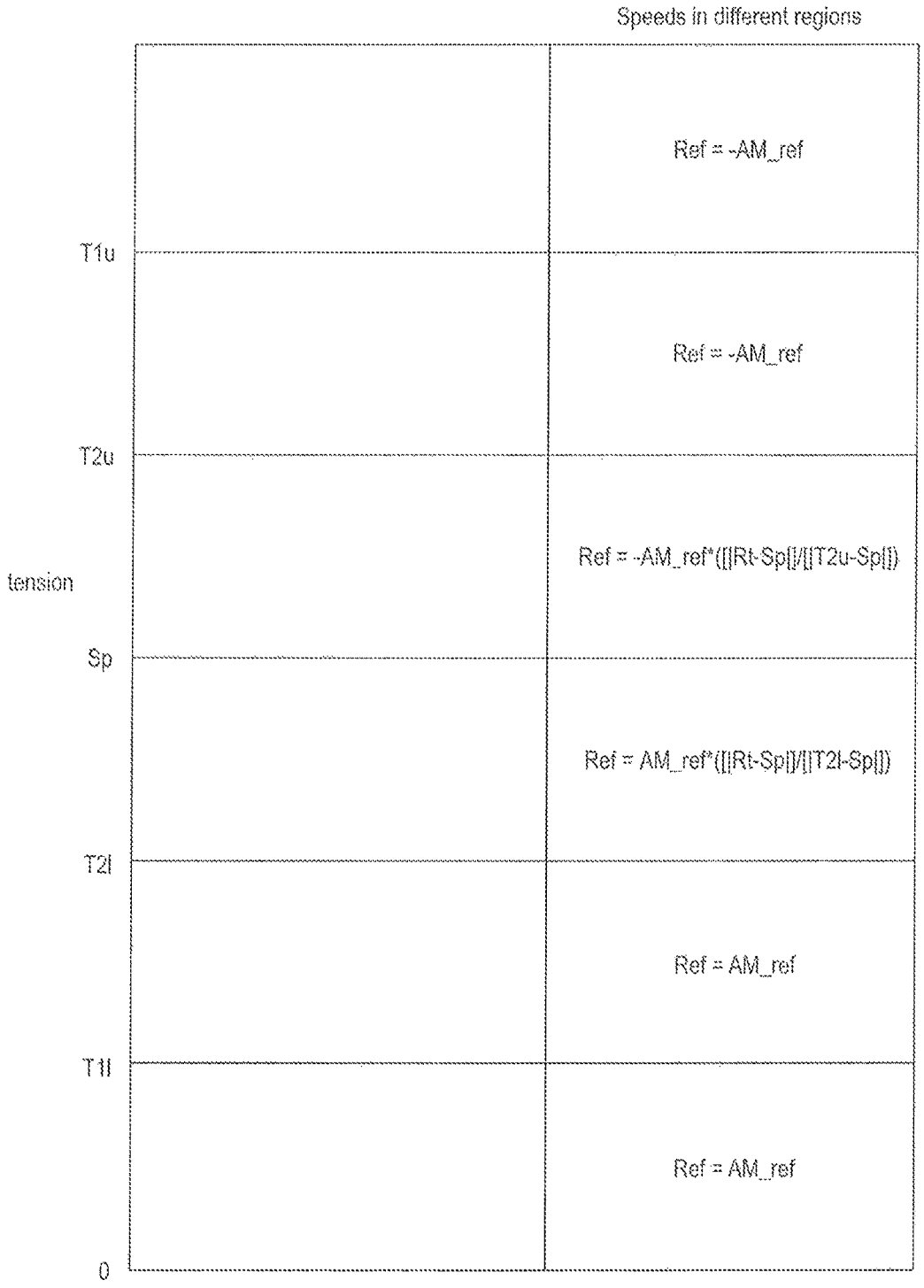
FIG. 3 illustrates speeds in different tension regions according to an embodiment.

FIG. 3 illustrates, according to an embodiment, speed settings in different regions of the tension of the spoolable medium 10 between the vessel and the point of mooring when the winch drum 20 is being driven. According to this example, when the tension is higher than the second upper tension threshold T2*u*, the speed setting is −AM_ref, i.e. spooling out. Between the second upper tension threshold T2*u* and the predetermined tension set point Sp, the speed setting is −AM_ref*([|Rt−Sp|]/[|T2*u*−Sp|]), i.e. spooling out. Between the second lower tension threshold T2*l* and the predetermined tension set point Sp, the speed setting is AM_ref*([|Rt−Sp|]/[|T2*l*−Sp|]), i.e. spooling in. And, when the tension is lower than the second lower tension threshold T2*l*, the speed setting is AM_ref, i.e. spooling in.

An apparatus implementing the control functions according to any one of the above embodiments, or a combination thereof, may be implemented as one unit or as two or more separate units that are configured to implement the functionality of the various embodiments. Here the term 'unit' refers generally to a physical or logical entity, such as a physical device or a part thereof or a software routine. One or more of these units, such as the control unit 41, may reside in an electric drive or a component thereof such as the inverter 40, for example.

An apparatus, such as the control unit 41, according to any one of the embodiments may be implemented at least partly by means of one or more computers or corresponding digital signal processing (DSP) equipment provided with suitable software, for example. Such a computer or digital signal processing equipment preferably comprises at least a working memory (RAM) providing storage area for arithmetical operations and a central processing unit (CPU), such as a general-purpose digital signal processor. The CPU may comprise a set of registers, an arithmetic logic unit, and a CPU control unit. The CPU control unit is controlled by a sequence of program instructions transferred to the CPU from the RAM. The CPU control unit may contain a number of microinstructions for basic operations. The implementation of microinstructions may vary depending on the CPU design. The program instructions may be coded by a programming language, which may be a high-level programming language, such as C, Java, etc., or a low-level programming language, such as a machine language, or an assembler. The computer may also have an operating system which may provide system services to a computer program written with the program instructions. The computer or other apparatus implementing the invention, or a part thereof, may further comprise suitable input means for receiving e.g. measurement and/or control data, and output means for outputting e.g. control data. It is also possible to use a specific integrated circuit or circuits, or discrete electric components and devices for implementing the functionality according to any one of the embodiments.

The invention according to any one of the embodiments, or any combination thereof, can be implemented in existing system elements, such as electric drives or components thereof, such as inverters or frequency converters, or similar devices, or by using separate dedicated elements or devices in a centralized or distributed manner. Present devices for electric drives, such as inverters and frequency converters, typically comprise processors and memory that can be utilized in the functions according to embodiments of the invention. Thus, all modifications and configurations required for implementing an embodiment of the invention e.g. in existing devices may be performed as software routines, which may be implemented as added or updated software routines. If the functionality of the invention is implemented by software, such software can be provided as a computer program product comprising computer program code which, when run on a computer, causes the computer or corresponding arrangement to perform the functionality according to the invention as described above. Such a computer program code may be stored or generally embodied on a computer readable medium, such as suitable memory, e.g. a flash memory or a disc memory from which it is loadable to the unit or units executing the program code. In addition, such a computer program code implementing the invention may be loaded to the unit or units executing the computer program code via a suitable data network, for example, and it may replace or update a possibly existing program code.

It is obvious to a person skilled in the art that as technology advances, the basic idea of the invention can be implemented in a variety of ways. Consequently, the invention and its embodiments are not restricted to the above examples, but can vary within the scope of the claims.

The invention claimed is:

1. A method for operating a winch comprising a winch drum for spooling a spoolable medium for mooring a vessel, the method comprising:

monitoring a tension of the spoolable medium between the vessel and a point of mooring;

in response to the monitored tension of the spoolable medium becoming higher than a first upper tension threshold or lower than a first lower tension threshold, initiating, either immediately or after a first predetermined delay, driving of the winch drum, wherein, during the driving of the winch drum, when the monitored tension of the spoolable medium is higher than a predetermined tension set point, which has a value between the first upper tension threshold and the first lower tension threshold, the winch drum is driven in such a direction that the spoolable medium is spooled out, wherein, during the driving of the winch drum, when the monitored tension of the spoolable medium is lower than the predetermined tension set point, the winch drum is driven in such a direction that the spoolable medium is spooled in, and wherein, during the driving of the winch drum, at least when the monitored tension of the spoolable medium is between a second upper tension threshold, which has a value equal to or lower than the first upper tension threshold but higher than the predetermined tension set point, and a second lower tension threshold, which has a value equal to or higher than the first lower tension threshold but lower than the predetermined tension set point, an absolute value of the driving speed of the winch drum has a value that is proportional to an absolute value of a difference between the monitored tension of the spoolable medium and the predetermined tension set point; and in response to the monitored tension of the spoolable medium being, during the driving of the winch drum, between the second upper tension threshold and the second lower tension threshold for a second predetermined delay, stopping the driving of the winch drum.

2. The method of claim 1, wherein, during the driving of the winch drum, when the monitored tension of the spoolable medium is higher than the second upper tension threshold, or when the monitored tension of the spoolable medium is lower than the second lower tension threshold, the absolute value of the driving speed of the winch drum has a value that is a predetermined constant after the driving speed of the winch drum has reached said predetermined constant driving speed.

3. The method of claim 1, wherein the value of the absolute value of the driving speed of the winch drum is determined according to the following equations:

when the monitored tension of the spoolable medium is between the second upper tension threshold and the predetermined tension set point:

$$|Ref|=AM_ref*([|Rt-Sp|]/[|T2u-Sp|]),\text{ and}$$

when the monitored tension of the spoolable medium is between the second lower tension threshold and the predetermined tension set point:

$$|Ref|=AM_ref*([|Rt-Sp|]/[|T2l-Sp|]),$$

where:

Ref=the driving speed of the winch drum

AM_ref=a predetermined constant

Rt=the monitored tension of the spoolable medium

Sp=the predetermined tension set point

T2*u*=the second upper tension threshold

T2*l*=the second lower tension threshold.

4. The method of claim 1, wherein the winch drum is driven by an electric motor.

5. The method of claim 4, wherein the tension of the spoolable medium between the vessel and a point of mooring is monitored by monitoring a torque of the electric motor.

6. The method of claim 5, wherein the torque of the electric motor is monitored by monitoring a current of the electric motor.

7. A winch comprising:

a winch drum for spooling a spoolable medium for mooring a vessel;

a winch drive for driving the winch drum; and a controller configured to:

monitor a tension of the spoolable medium between the vessel and a point of mooring;

in response to the monitored tension of the spoolable medium becoming higher than a first upper tension threshold or lower than a first lower tension threshold, initiate, either immediately or after a first predetermined delay, driving of the winch drum, wherein, during the driving of the winch drum, when the monitored tension of the spoolable medium is higher than a predetermined tension set point, which has a value between the first upper tension threshold and the first lower tension threshold, the winch drive is configured to drive the winch drum in such a direction that the spoolable medium is spooled out, wherein, during the driving of the winch drum, when the monitored tension of the spoolable medium is lower than the predetermined tension set point, the winch drive is configured to drive the winch drum in such a direction that the spoolable medium is spooled in, and wherein, during the driving of the winch drum, at least when the monitored tension of the spoolable medium is between a second upper tension threshold, which has a value equal to or lower than the first upper tension threshold but higher than the predetermined tension set point, and a second lower tension threshold, which has a value equal to or higher than the first lower tension threshold but lower than the predetermined tension set point, an absolute value of the driving speed of the winch drum is configured to have a value that is proportional to an absolute value of a difference between the monitored tension of the spoolable medium and the predetermined tension set point; and in response to the monitored tension of the spoolable medium being, during the driving of the winch drum, between the second upper tension threshold and the second lower tension threshold for a second predetermined delay, stop the driving of the winch drum.

8. The winch of claim 7, wherein, during the driving of the winch drum, when the monitored tension of the spoolable medium is higher than the second upper tension threshold or when the monitored tension of the spoolable medium is lower than the second lower tension threshold, the absolute value of the driving speed of the winch drum is configured to have a value, which is a predetermined constant after the driving speed of the winch drum has reached said predetermined constant driving speed.

9. The winch of claim 7, wherein the winch drive is configured to determine the second value of the absolute value of the driving speed of the winch drum according to the following equations:

when the monitored tension of the spoolable medium is between the second upper tension threshold and the predetermined tension set point:

$$|Ref|=AM_ref*([|Rt-Sp|]/[|T2u-Sp|]), \text{ and}$$

when the monitored tension of the spoolable medium is between the second lower tension threshold and the predetermined tension set point:

$$|Ref|=AM_ref*([|Rt-Sp|]/[|T2l-Sp|]),$$

where:

Ref=the driving speed of the winch drum

AM_ref=a predetermined constant

Rt=the monitored tension of the spoolable medium

Sp=the predetermined tension set point

T2*u*=the second upper tension threshold

T2*l*=the second lower tension threshold.

10. The winch of claim 7, wherein the winch drive comprises an electric motor for driving the winch drum.

11. The winch of claim 10, wherein the winch drive is configured to monitor the tension of the spoolable medium between the vessel and a point of mooring by monitoring a torque of the electric motor.

12. The winch of claim 11, wherein the winch drive is configured to monitor the torque of the electric motor by monitoring a current of the electric motor.

13. The winch of claim 10, wherein the electric motor is an AC motor or a DC motor.

14. The winch of claim 7, wherein the spoolable medium is a cable, a rope, a wire or a chain.

15. A control system for a winch including a winch drum for spooling a spoolable medium for mooring a vessel and a winch drive for driving the winch drum, the control system comprising:

a controller for controlling the winch drive, the controller comprising a processor and a non-transitory computer readable medium storing instructions that, when executed by the processor, cause the controller to:

monitor a tension of the spoolable medium between the vessel and a point of mooring;

in response to the monitored tension of the spoolable medium becoming higher than a first upper tension threshold or lower than a first lower tension threshold, initiate, either immediately or after a first predetermined delay, driving of the winch drum, such that during the driving of the winch drum:

when the monitored tension of the spoolable medium is higher than a predetermined tension set point, which has a value between the first upper tension threshold and the first lower tension threshold, the winch drum is driven in such a direction that the spoolable medium is spooled out, when the monitored tension of the spoolable medium is lower than the predetermined tension set point, the winch drum is driven in such a direction that the spoolable medium is spooled in, and at least when the monitored tension of the spoolable medium is between a second upper tension threshold, which has a value equal to or lower than the first upper tension threshold but higher than the predetermined tension set point, and a second lower tension threshold, which has a value equal to or higher than the first lower tension threshold but lower than the predetermined tension set point, an absolute value of the driving speed of the winch drum has a value that is proportional to an absolute value of a difference between the monitored tension of the spoolable medium and the predetermined tension set point; and in response to the monitored tension of the spoolable medium being, during the driving of the winch drum, between the second upper tension threshold and the second lower tension threshold for a second predetermined delay, stop the driving of the winch drum.

* * * * *